US007619177B2

(12) United States Patent
Saxl et al.

(10) Patent No.: US 7,619,177 B2
(45) Date of Patent: Nov. 17, 2009

(54) NOZZLE FASTENING FOR ELECTRICAL SWITCHING APPARATUS

(75) Inventors: David Saxl, Zurich (CH); Markus Vestner, Buesingen (CH); Thomas Nordstrom, Ludvika (SE); Tomas Borg, Ludvika (SE); Tomas Strom, Ludvika (SE); Olaf Hunger, Schaffhausen (CH)

(73) Assignee: ABB Technology AG, Zurich (CH)

( * ) Notice: Subject to any disclaimer, the term of this patent is extended or adjusted under 35 U.S.C. 154(b) by 25 days.

(21) Appl. No.: 11/879,508

(22) Filed: Jul. 18, 2007

(65) Prior Publication Data

US 2007/0295693 A1 Dec. 27, 2007

Related U.S. Application Data

(63) Continuation of application No. PCT/CH2006/000053, filed on Jan. 25, 2006.

(30) Foreign Application Priority Data

Feb. 1, 2005 (EP) ..... 05405049

(51) Int. Cl.
*H01H 33/88* (2006.01)

(52) U.S. Cl. ..... 218/63; 218/57

(58) Field of Classification Search ..... 218/43, 218/48–54, 57–66, 72, 73
See application file for complete search history.

(56) References Cited

U.S. PATENT DOCUMENTS 3,930,133 A * 12/1975 Sulzer ..... 200/47
5,424,503 A 6/1995 Neveu
6,018,133 A * 1/2000 Thuries ..... 218/43

FOREIGN PATENT DOCUMENTS

| | | |
|---|---|---|
| EP | 0 735 555 B1 | 10/1996 |
| EP | 0 806 049 B1 | 11/1997 |
| EP | 0 809 268 B1 | 11/1997 |

(Continued)

OTHER PUBLICATIONS

English language version of Form PCT/IB/409 (International Preliminary Report on Patentability), Aug. 8, 2006.

(Continued)

*Primary Examiner*—Renee S Luebke
*Assistant Examiner*—Marina Fishman
(74) *Attorney, Agent, or Firm*—Buchanan Ingersoll & Rooney PC

(57) ABSTRACT

An electrical switching apparatus is disclosed with a moveable insulating nozzle for blowing an arc. According to the invention, the insulating nozzle is connected in an interlocking and force-fitting manner to at least one moveable component part of the switching apparatus by means of a clamping device and without a screw connection. Exemplary embodiments relate, inter alia, to: a clamping hold of the insulating nozzle on the moving buffer cylinder and/or at the opposite end on a part to be moved, in particular a moveable shielding electrode or an auxiliary gear mechanism for a contact system, which is driven on both sides. Advantages include: simple fitting of the insulating nozzle, small physical volume of the clamping device; precise coaxial fixing of the insulating nozzle in relation to the switch axis.

24 Claims, 4 Drawing Sheets

FOREIGN PATENT DOCUMENTS

| | | |
|---|---|---|
| FR | 2.093.339 | 1/1972 |
| WO | 96/21234 A1 | 7/1996 |

OTHER PUBLICATIONS

Form PCT/ISA/210 (International Search Report) dated Apr. 3, 2006.
Form PCT/ISA/237 (Written Opinion of the International Searching Authority), Aug. 8, 2006.
Form PCT/IPEA/409 (International Preliminary Report on Patentability) dated Aug. 8, 2006.
European Search Report (with English translation of category of cited documents) dated Sep. 21, 2005.

* cited by examiner

NOZZLE FASTENING FOR ELECTRICAL SWITCHING APPARATUS

RELATED APPLICATIONS

This application claims priority under 35 U.S.C. §119 to EP Application 05405049.7 filed in Europe on Feb. 1, 2005, and as a continuation application under 35 U.S.C. §120 to PCT/CH2006/000053 filed as an International Application on Jan. 25, 2006, designating the U.S., the entire contents of which are hereby incorporated by reference in their entireties.

TECHNICAL FIELD

The disclosure relates to the field of high-voltage engineering, e.g., high-voltage switch technology in electrical power distribution systems. It is based on an interrupter unit for a switching apparatus and on a switching apparatus.

BACKGROUND INFORMATION

EP 0 809 268 B1 describes a circuit breaker having a switch drive, which moves the first arcing contact and also drives the opposite second arcing contact via an auxiliary gear mechanism, which is articulated on the insulating nozzle. For the articulation of the auxiliary gear mechanism, the insulating nozzle has a bead or flange on the outer surface at its first end. A first tensioning ring is pushed on over the bead and is snapped in behind it. From the push-on side, a second tensioning ring is fixed to the nozzle end so as to prevent the first tensioning ring from becoming unlatched. The auxiliary gear mechanism to be driven is fastened to the second tensioning ring. At the opposite second nozzle end, the nozzle is connected to the switch drive by virtue of the fact that the nozzle in turn has a bead or flange at the point at which force is introduced, which bead or flange is clamped in or screwed between two solid force-transmitting component parts. This results in a voluminous holding device for fastening the nozzle to the component parts driven by the switch drive.

In U.S. Pat. No. 5,424,503, an interrupter unit of the generic type for an electrical switching apparatus having a first moveable contact part with an insulating nozzle and a second contact part is disclosed. The insulating nozzle has a tab and is held against said tab by the rated current contact in the form of a clamping holder in the axial direction and pressed against a carrier body. The clamping device also comprises a holding ring, which fixes the end of the rated current contact to the carrier body by virtue of radial clamping.

FR 2 093 339 A has described an electrical self-blowing switch having an insulating nozzle, which is pushed onto a holder and is thus held by virtue of clamping. The insulating nozzle has a two-part design for simplified fitting of the contacts in the switch and comprises a basic body and an attachment piece, both consisting of plastic. Conventionally, the attachment piece has been adhesively bonded to the basic body in seamless fashion. Now, the attachment piece is connected to the basic body such that it can be detached and replaced by an external groove being provided on the basic body and an internal groove being provided on the attachment piece and by an annular wedge engaging in the internal groove and the external groove. The annular wedge is flexible and can have a toothed design on its inside so as to secure it against sliding. This type of flexible wedging allows the lightweight attachment piece to be held in clamping fashion on the basic body, but would be unsuitable for holding the insulating nozzle on the component part in a clamping fashion. Since the annular wedge is arranged in a zone which is subjected to a strong field, it should also consist of plastic. During fitting, the annular wedge is inserted through an opening into the internal groove and external groove in order to wedge the attachment piece and the basic body with one another.

SUMMARY

A simplified, more compact hold is disclosed for an insulating nozzle on a component part transferring the drive movement, in a switching apparatus having an insulating nozzle for blowing an arc.

An interrupter unit is disclosed for an electrical switching apparatus for power supply systems, in particular high-voltage switch, the switching apparatus having a central axis and at least one first contact part with an insulating nozzle for blowing an arc and a second contact part, it being possible for at least one of the contact parts to move by virtue of a switch drive, a holding device for connecting the insulating nozzle to a component part, which can move by virtue of the switch drive, of the interrupter unit being provided, wherein, in addition the holding device is a clamping device, which produces a mechanical connection between the insulating nozzle and the component part by virtue of a clamping hold and without a screw connection. Owing to the clamping device, the processing of the insulating nozzle is reduced to a minimum and drilled holes or slots in the insulating nozzle are not required. No additional fastening parts or components are required. The clamping device is not screwed or fastened either to the insulating nozzle or to the component part, but an essentially interlocking and force-fitting connection between the insulating nozzle and the moveable component part is only produced by clamping or pressing together.

In this case, the clamping device comprises a holding ring, which is supported on the component part. The holding ring ensures fixing of the insulating nozzle with a precise alignment coaxially with respect to the central axis of the interrupter unit.

According to the invention, the holding ring fixes the insulating nozzle in the axial direction by virtue of clamping, the holding ring having a restraining face for securing the insulating nozzle against sliding out in a first axial direction.

An exemplary embodiment has the advantage of it being easier to fit the insulating nozzle, particularly in switching apparatuses with contact parts which are driven on both sides or with a shielding electrode which can move via the insulating nozzle.

Further exemplary embodiments can relate to a design-oriented refinement of the clamping device, to a clamping device of the insulating nozzle on the switch-drive side or to a clamping device on the switch side remote from the switch drive.

Another exemplary embodiment with a holding ring and groove has the advantage that the fastening of the insulating nozzle to the buffer cylinder of the interrupter unit is extremely compact. This solution can be advantageous for buffer cylinders, which are produced using so-called copper technology, i.e. by means of the deformation of very thin copper sheets or copper tubes or generally by the deformation of sheets or tubes consisting of other electrically conductive materials.

Yet other exemplary embodiments can have the advantage that, by virtue of the spring element and possibly the protective element, the mechanical manufacturing and fitting tolerances can be increased and, at the same time, a highly precise axial alignment of the insulating nozzle in the interrupter unit is achieved.

The disclosure can also relate to an electrical switching apparatus with an arc interrupter unit as described above and with the advantages mentioned there.

Further refinements, advantages and applications of the invention can result from the following description and the figures.

BRIEF DESCRIPTION OF THE DRAWINGS

In the schematic drawings.

In the figures, identical parts are provided with the same reference symbols.

DETAILED DESCRIPTION

Figure 1:
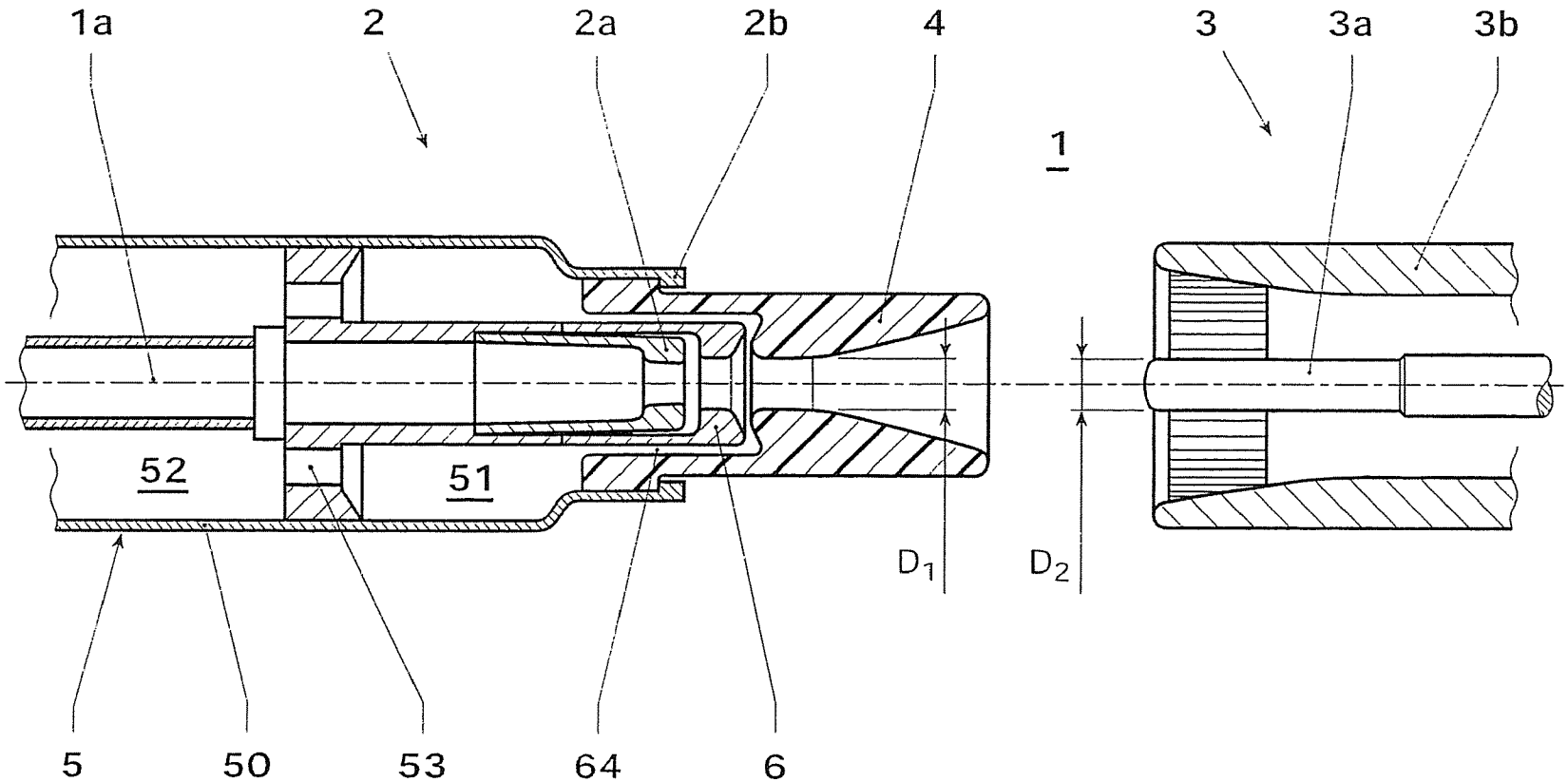
PRIOR ART Fig. 1
FIG. 1 shows a switching apparatus of the generic type comprising a first contact part with an insulating nozzle and a second contact part with a contact pin and contact tulip.

FIG. 1 shows, for an electrical switching apparatus 1, in this case, by way of example, for a circuit breaker, the arc interrupter unit, in a schematic and sectional illustration. The interrupter unit has a central axis 1*a* and at least one first contact part 2 with an insulating nozzle 4 for blowing an arc and a second contact part 3. The contact parts 2, 3 are typically arranged concentrically with respect to the central axis 12. At least one of the contact parts 2, 3 can move by virtue of a switch drive (not illustrated). The first contact part 2 in this case comprises a first arcing contact 2*a* in the form of a contact tulip 2*a* and an externally arranged first rated current contact 2*b* in the form of a contact tube 2*b*, which is in the form of a continuation of the wall 50 of a buffer cylinder 5. In the case of self-blowing switches (as illustrated by way of example), the buffer cylinder 5 has a heating volume 51 and a precompression volume 52, which are separated by a base 53 with a valve flap. The second contact part 3 in this case comprises a second arcing contact 3*a* in the form of a contact pin 3*a* and, externally, a second rated current contact 3*b* in the form of a contact tulip 3*b*. The insulating nozzle 4 is fastened, by way of example, to the first contact part 2, to the rated current contact 2*b*. The main nozzle 4 and the auxiliary nozzle 6 delimit the heating channel 64. In the event of switching, quenching gases flow from the buffer cylinder 5 through the heating channel 64 to the front opening of the main nozzle 4 and blow the arc. Reference will be made to the fact that the invention described further below can be used in self-blowing switches, in buffer switches or else in other types of switch or switching apparatuses with other switch principles.

Figure 2:
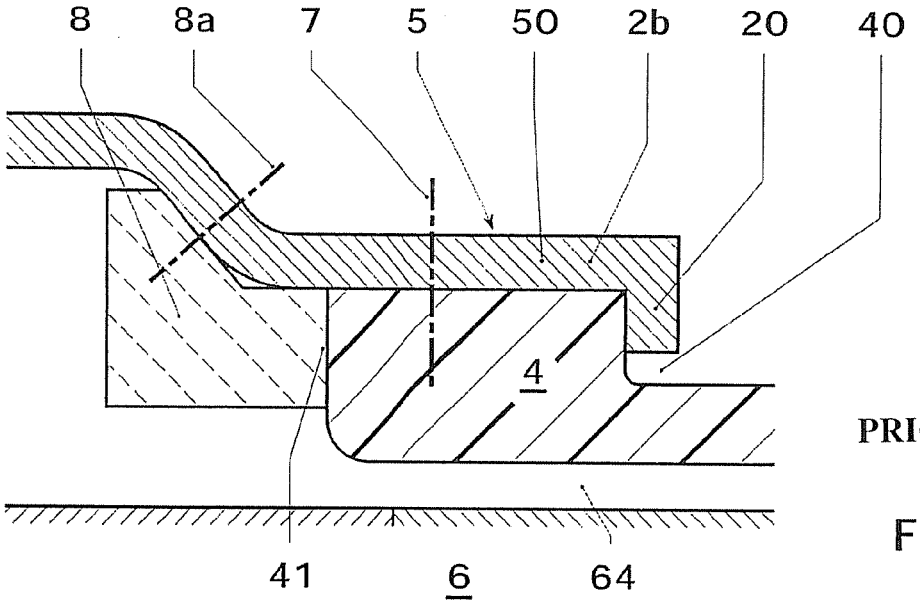
PRIOR ART Fig. 2
FIG. 2 shows conventional fitting means for fastening the insulating nozzle to the first contact part.

FIG. 2 shows conventional embodiments for fastening the main or insulating nozzle 4 to the moveable component part 5, in this case the buffer cylinder 5. Until now, buffer cylinders 5 with a considerable wall thickness have been used, into which a drilled hole 7, 8*a* has been introduced in order to screw the insulating nozzle 4 to the buffer cylinder wall 50. The drilled hole 7 can be guided directly into the insulating nozzle 4 or into a mounting block 8, the mounting block 8 being pressed onto the end side 41 of the insulating nozzle 4 and thereby fixing the latter on one side. On an opposite side, the insulating nozzle 4 has an undercut or recess 40, in which an overhang or a projection 20 in the rated current contact tube 2*b* engages and, as a result, also fixes the insulating nozzle 4 on the other side.

According to the invention, a holding device for connecting the insulating nozzle 4 to a component part 5; 13, 14, which can move by virtue of the switch drive, of the interrupter unit is provided, the holding device acting as a clamping device 9, 10, 11; 12, which produces a mechanical connection between the insulating nozzle 4 and the component part 5; 13, 14 by virtue of clamping 9, 5*a*, 5*b*, 5*c*; 12, 13*a*, 13*b*, 13*c* and without a screw connection. The invention can be used at the first end, on the switch-drive side, or at the second end, which is remote from the switch drive, of the insulating nozzle 4.

Preferably, the clamping device 9, 10, 11; 12 comprises a holding ring 9, 12, which is supported on the component part 5, 13 and fixes the insulating nozzle 4 in the axial direction 91, 92 by virtue of clamping, the holding ring 9, 12 ensuring fixing of the insulating nozzle 4 with a precise alignment coaxially with respect to the central axis 1*a*. The term ring or annular below also includes ring segment or partially annular. The coaxial alignment is required since a small distance tolerance of approximately 1 mm to a few mm should be maintained over the entire insertion length of the contact pin 3*a* in the nozzle 4 between the outer diameter $D_2$ of the arcing contact pin 3*a* and the inner diameter of the insulating nozzle 4 (FIG. 1). Accordingly, small tolerances should be adhered to in the coaxial alignment in order to safely rule out an angled or tilted position of the arcing contact pin 3*a* in the insulating nozzle 4.

Advantageously, the clamping device 9, 10, 11; 12 and/or the insulating nozzle 4 can rotate during fitting in relation to the component part 5, 13 about the central axis 1*a*. In one preferred design-oriented refinement, the clamping device 9, 10, 11; 12, in particular the holding ring 9, 12, has a restraining face 9*a*, 12*a* for securing the insulating nozzle 4 against sliding out in a first axial direction 91 and/or a clamping face 9*b*, 12*b* for supporting the clamping device 9, 10, 11; 12 on the component part 5; 13, 14 in the first axial direction 91.

Figure 3A:
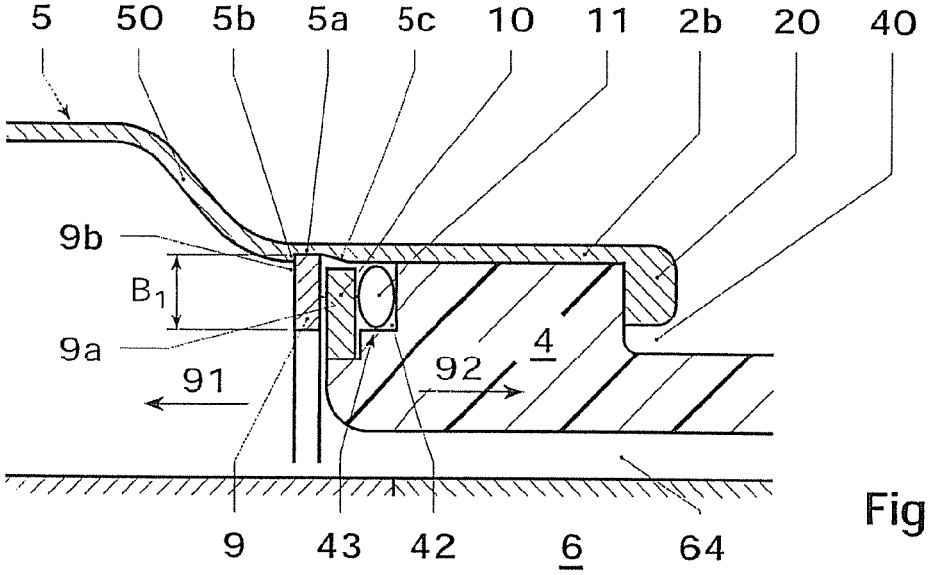
FIGS. 3*a*, 3*b* show an exemplary embodiment of the invention with a special holding device for fastening the insulating nozzle to the first contact part.
Figure 3B:
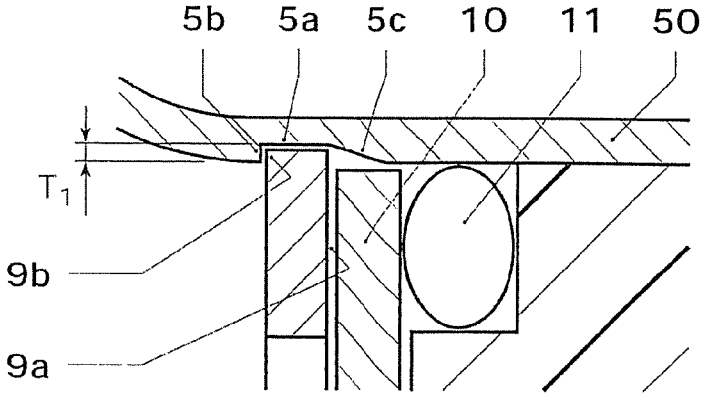

FIGS. 3*a*, 3*b* show a first exemplary embodiment, in which the component part 5 is a moveable buffer cylinder 5 with a buffer cylinder wall 50, which has an internal groove 5*a*, and the clamping device 9, 10, 11 comprises a spring-securing ring 9, which fixes the insulating nozzle 4 to the buffer cylinder 5 by means of engaging in the internal groove 5*a* and by protruding radially inwards from the internal groove 5*a* and transfers a switch drive force acting in the axial direction 91, 92 from the buffer cylinder 5 to the insulating nozzle 4. The protrusion ensures in particular that the spring-securing ring 9 is mechanically connected to an end side of the insulating nozzle 4 and exerts a restraining force on the end side. The groove depth or undercut depth $T_1$ of the internal groove 5*a* in the buffer cylinder wall 5 should be selected for this purpose to be smaller than a ring width $B_1$ of the spring-securing ring 9.

Advantageously, the buffer cylinder wall 50 is manufactured from a sheet or tube, in particular a copper sheet or copper tube, and has a wall thickness of less than 7 mm, preferably less than 5 mm, particularly preferably less than 3.5 mm; and/or the internal groove 5*a* has an undercut depth $T_1$ in a range of from 0.8 mm to 3.0 mm, preferably 1.0 mm to 2.0 mm, particularly preferably equal to 1.5 mm. A decisive advantage of the clamping fastening consists in the fact that even component parts 5 with walls 50 consisting of thin, possibly deformed sheets or tubes can be connected in an interlocking and force-fitting manner to the insulating nozzle 4 simply by means of clamping fastening. Such sheets or tubes are preferably manufactured from copper. This so-called copper technology is described in detail in the European patents EP 0 735 555 and EP 0 806 409, which are incorporated by reference, with their entire disclosure content, in the description.

Figure 4:
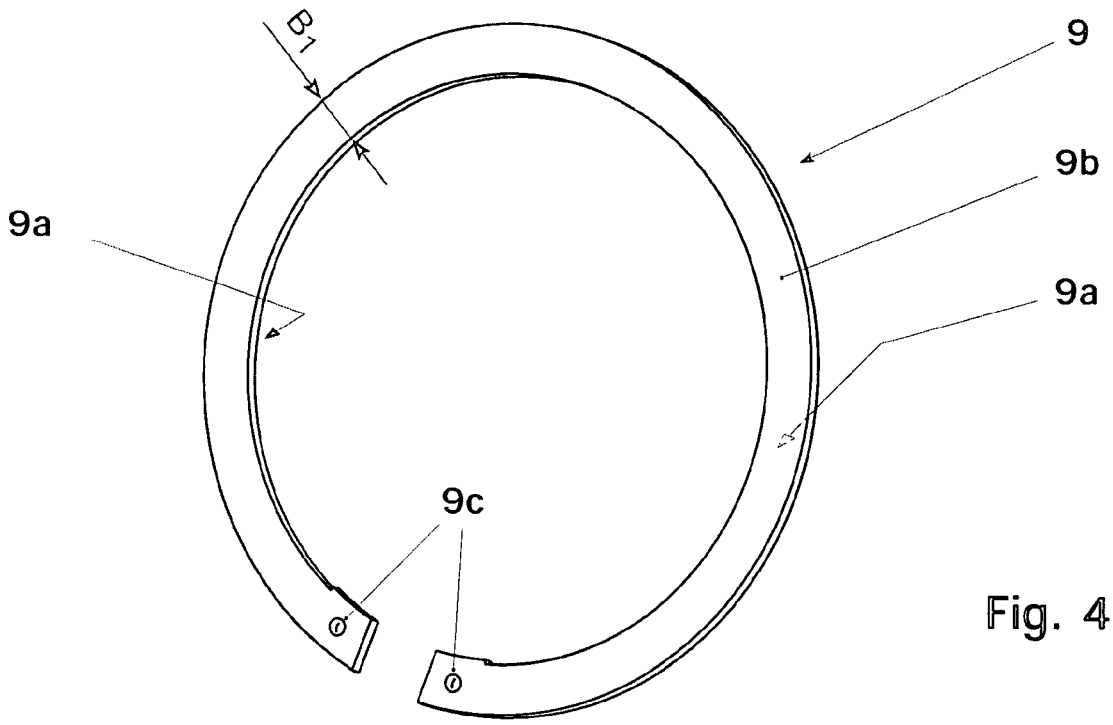
FIGS. 4, 6 show exemplary embodiments of the spring-securing rings for clamping the insulating nozzle.

FIG. 4 shows, as the spring-securing ring 9, a Seeger ring 9 known per se. The ring width $B_1$ is selected such that the mentioned end-side restraining face 9*a* and clamping face 9*b* have a sufficiently large area for absorbing and transferring the clamping forces. During fitting, the Seeger ring 9 is constricted by special pincers engaging in the holes 9*c*, inserted into the buffer cylinder 5 in the axial direction 92 and snapped into the internal groove 5*a* in the buffer cylinder wall 50.

FIGS. 3*a*, 3*b* also show a further exemplary embodiment, in which the clamping device 9, 10, 11 comprises an annular spring element 11, which can undergo a spring deflection in the axial direction 92 and is arranged between the spring-securing ring 9 and the insulating nozzle 4, in particular in a recess 42 there in the insulating nozzle 4. The spring element 11 may be, for example, a conventional O ring 11, a helical spring, a wave spring or a disk spring for producing an axial spring force. As illustrated, the internal groove 5*a* may have a bevel 5*c* for inserting the spring element 11 without damaging it. The spring element 11 provides an axial and transverse tolerance of the component part 1 and the insulating nozzle 4 during fitting and at the same time brings about precise alignment of the nozzle 4.

One further improvement is achieved if an annular protective element 10, preferably a washer 10, for mechanically and thermally protecting the spring element 11 and the insulating nozzle 4 is provided between the spring-securing ring 9 and the spring element 11 and is supported on a dimensionally stable projection 43 of the insulating nozzle 4. The interaction of the protective element 10 with the dimensionally stable, force-absorbing projection 43 ensures that, under the contact pressure, no lasting deformation of the Teflon material of the insulating nozzle 4 occurs. The protective element 10 can be integrated in the clamping device 9, 10, 11, in particular in the spring-securing ring 9 (not illustrated).

Figure 5B:
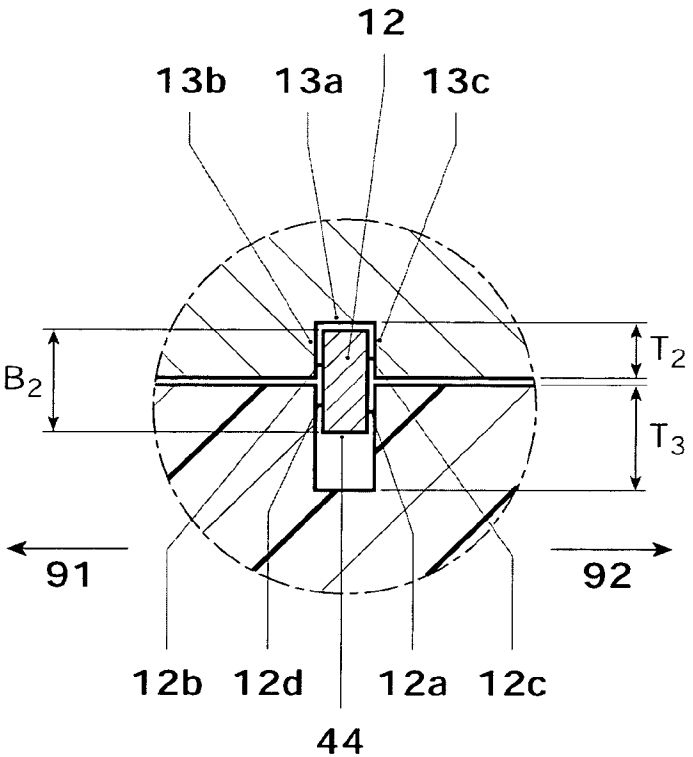
FIGS. 5*a*, 5*b* show a further exemplary embodiment with a special holding device for fastening a part to be moved to the insulating nozzle.
Figure 5A:
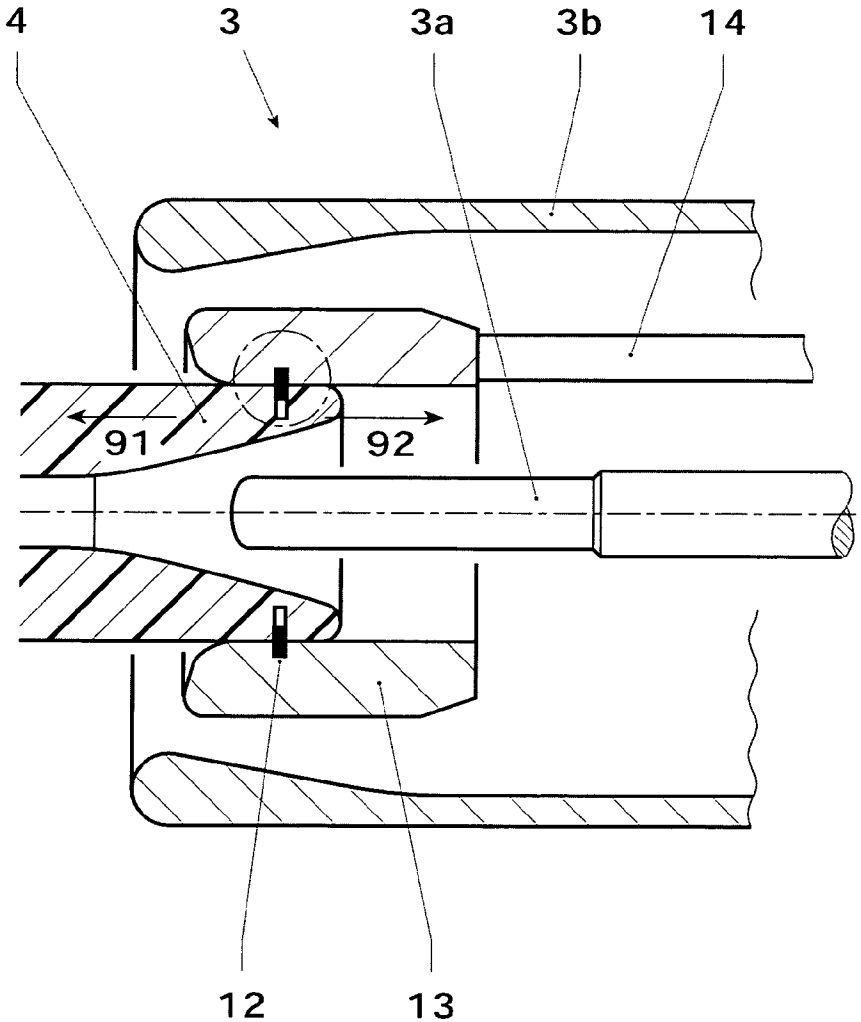

FIGS. 5*a*, 5*b* show a second exemplary embodiment, in which the clamping device 12 has a second restraining face 12*d* for securing the insulating nozzle 4 against sliding out in a second axial direction 92, which is opposite to the first axial direction 91 and/or the clamping device 12 has a second clamping face 12*c* for supporting the clamping device 12 on the component part 13 in the opposite second axial direction 92. The moveable component part 13, 14 may be a coupling element 13 for a moveable part 14 to be driven, in particular for a moveable shielding electrode or for an auxiliary gear mechanism 14 of the switch drive. In this case, the coupling element 13 has an internal groove 13*a*, and the insulating nozzle 4 has an external groove 44, and the clamping device 12 comprises a spring-securing ring 12, which at the same time engages in the internal groove 13*a* and the external groove 44 in the manner of a snap-action closure. For this purpose, in particular the groove depth or undercut depth $T_2$ of the internal groove 13*a* is selected to be smaller than the ring width $B_2$ of the snap-action closure 12. The spring-securing ring 12 or snap-action closure 12 replaces a conventional fitting procedure, in the case of which the two parts 4, 13 are connected to one another via a thread. The snap-action closure 12 has the advantage of being fitted in a simple, interlocking and force-fitting manner and of a connection which can rotate during fitting, by means of which, for example, the toothed rod 14 can be brought into an appropriate position with respect to the gear mechanism. Owing to the possible ability to rotate, alternatively the moving contact 2 or buffer cylinder 5 can be brought into any desired azimuthal position, with the result that the contact 2 can be aligned with one of the phase terminals, which is arranged inclined towards the outside.

Figure 6:
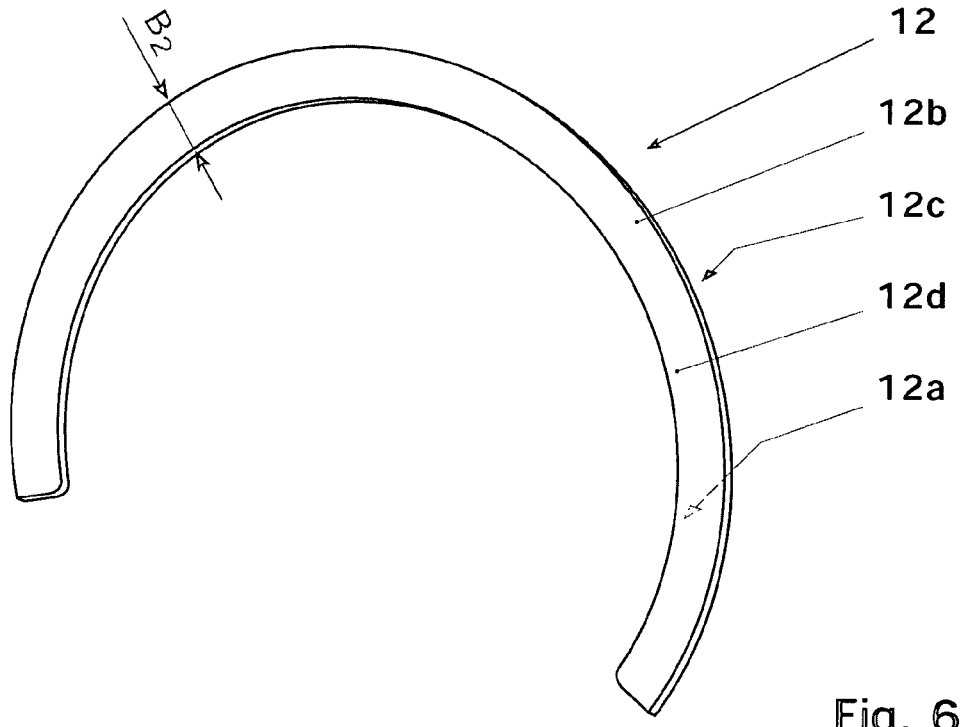

FIG. 6 shows an exemplary embodiment of such a spring-securing ring 12. The spring-securing ring 12 may be a ring segment 12 with an arc length in the range of from 180° to 280°, preferably from 200° to 250°, particularly preferably of 230°. The range is limited at the top and bottom by a sufficient ability of the spring-securing ring 12 to spread apart or a sufficient radial clamping effect of the spring-securing ring 12 in the fitted state. The spring-securing ring 12 should therefore be capable of being bent up and inserted into the external groove 44 radially from the outside. The spring-securing ring 12 should also be capable of being pressed completely into the external groove 44 when the component part 13, 14 is pushed on. For this purpose, in particular the groove depth or undercut depth $T_3$ of the external groove 13*a* is selected to be deeper than the ring width $B_2$ of the snap-action closure 12. The spring-securing ring 12 should also spring back or be capable of latching into the internal groove 13*a* by means of an elastic resetting force in the pushed-on state of the component part 13, 14. For this purpose, the spring-securing ring 12 should be manufactured from an elastic material, such as spring steel, for example.

The subject matter of the invention is also an electrical switching apparatus for a power supply system, in particular a switching apparatus with a moveable insulating nozzle 4 for blowing an arc, for example a high-voltage switch or breaker, high-current switch or breaker, or power circuit breaker, which has the above-described interrupter unit.

In such a switching apparatus, the insulating nozzle 4 can be connected on both sides to in each case one moveable component part 5, 13, 14 by virtue of in each case one clamping device 9, 10, 11; 12, the two clamping devices 9, 10, 11; 12 in each case producing an interlocking and force-fitting connection between the insulating nozzle 4 and the associated component part 5, 13, 14 by virtue of a clamping hold 9, 5*a*, 5*b*, 5*c*; 12, 13*a*, 13*b*, 13*c* and without a screw connection. For example, a first clamping device 9, 10, 11 for mechanically connecting the insulating nozzle 4 to a moveable buffer cylinder 5 of the interrupter unit and a second clamping device 12 for mechanically connecting the insulating nozzle 4 to a coupling element 13 for a part 14 to be driven of the interrupter unit are provided. The part 14 to be driven may be a moveable shielding electrode or an auxiliary gear mechanism 14, for example for a contact system 2, 3 which is driven on both sides.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Electrical switching apparatus, high-voltage switch, circuit breaker
1*a* Central axis, switch axis
2 First contact part (with insulating nozzle)
2*a* First arcing contact, arcing contact tulip
2*b* First rated current contact, contact tube

20 Overhang, projection in rated current contact tube
3 Second contact part, tulip/pin contact, current path contact, mating contact
3*a* Second arcing contact, arcing contact pin
3*b* Second rated current contact, rated current contact tulip
4 Insulating nozzle
40 First undercut, first recess in nozzle
41 End side of nozzle
42 Second undercut, second recess in nozzle, recess in end side of nozzle
43 Projection
44 Groove in nozzle
5 Moving contact, buffer cylinder (preferably using copper technology)
5*a* Internal groove in buffer cylinder
5*b* Supporting face on buffer cylinder
5*c* Bevel on buffer cylinder wall
50 Buffer cylinder wall
51 Heating volume
52 Precompression volume
53 Base with valve flap
6 Auxiliary nozzle
64 Heating channel
7 Screw connection
8 Mounting block
8*a* Screw connection for mounting block
9 Clamping device, rotatable axial clamping fixing, ring segment, holding ring, spring-securing ring, Seeger ring
9*a* Restraining face
9*b* Clamping face
9*c* Holes in spring-securing ring (Seeger ring)
91 First axial direction
92 Second axial direction
10 Protective ring, washer
11 Spring element, O ring
12 Clamping device, rotatable axial clamping fixing, ring segment, holding ring, steel ring, spring-securing ring, clip closure, snap-action closure
12*a* Restraining face
12*b* Clamping face
12*c* Second clamping face
12*d* Second restraining face
13, 14 Moveable component part
13 Coupling element
13*a* Internal groove in coupling element
13*b*, 13*c* First, second support face on coupling element
14 Kinematic connection, part to be moved, drive rod for auxiliary gear mechanism, moveable shielding electrode
$B_1$ Ring width of Seeger ring
$B_2$ Ring width of snap-action closure
$D_1$ Inner diameter of insulating nozzle
$D_2$ Outer diameter of arcing contact pin
$T_1$ Groove depth in buffer cylinder wall
$T_2$ Internal groove depth in component part
$T_3$ External groove depth in insulating nozzle

What is claimed is:

1. An interrupter unit for an electrical switching apparatus for power supply systems, the switching apparatus comprising a central axis and at least one first contact part with an insulating nozzle for blowing an arc and a second contact part and at least one of the contact parts being moveable by a switch drive, a holding device for connecting a first side of the insulating nozzle to a component part, which can move by the switch drive, of the interrupter unit being provided, wherein, the holding device produces a mechanical connection between the insulating nozzle and the component part by a clamping hold, the holding device comprises a holding ring, which is supported on the component part and which ensures fixing of the insulating nozzle with an alignment coaxially with respect to the central axis, and the holding ring fixes the insulating nozzle in the axial direction by clamping and has a restraining face for securing the insulating nozzle against sliding out in a first axial direction, wherein a) the component part is a buffer cylinder with a buffer cylinder wall, which has an internal groove, and b) the holding ring is a spring-securing ring, which fixes the insulating nozzle to the buffer cylinder by engaging in the internal groove and by protruding radially inwards from the internal groove and transfers a switch drive force acting in the axial direction from the buffer cylinder to the insulating nozzle, wherein c) the holding device and/or the insulating nozzle can rotate during fitting in relation to the component part about the central axis.

2. The interrupter unit as claimed in claim 1, wherein the holding ring has a clamping face for being supported on the component part in the first axial direction.

3. The interrupter unit as claimed in claim 1, wherein a) the buffer cylinder wall is manufactured from a sheet or tube and has a wall thickness of less than 7 mm, and/or b) the internal groove has an undercut depth $T_1$ in a range of from 0.8 mm to 3.0 mm.

4. The interrupter unit as claimed in claim 1, wherein the holding device comprises an annular spring element, which can undergo a spring deflection in the axial direction and is arranged between the spring-securing ring and the insulating nozzle in a recess in the insulating nozzle.

5. The interrupter unit as claimed in claim 1, wherein a) the internal groove has a supporting face for interacting with the clamping face, and/or b) the internal groove has a bevel for inserting the spring element without damaging it.

6. An electrical switching apparatus for a power supply system, characterized by an interrupter unit as claimed in claim 1.

7. The interrupter unit as claimed in claim 1 wherein the mechanical connection between the insulating nozzle and the component is without a screw connection.

8. The interrupter unit as claimed in claim 3, the buffer cylinder wall being manufactured from a copper sheet or copper tube, and has a wall thickness of less than 5 mm or less than 3.5 mm.

9. The interrupter unit as claimed in claim 3, the internal groove having an undercut depth $T_1$ in a range of from 1.0 mm to 2.0 mm or equal to 1.5 mm.

10. The interrupter unit as claimed in claim 4, wherein the spring element is an O ring, a helical spring, a wave spring or a disk spring for producing an axial spring force.

11. The interrupter unit as claimed in claim 4, wherein an annular protective element for mechanically and thermally protecting the spring element and the insulating nozzle is provided between the spring-securing ring and the spring element and is supported on a dimensionally stable projection of the insulating nozzle.

12. The interrupter unit as claimed in claim 4, wherein a) the internal groove has a supporting face for interacting with the clamping face, and/or b) the internal groove has a bevel for inserting the spring element without damaging it.

13. The interrupter unit as claimed in claim 11, wherein the annular protective element is a washer or the protective element is integrated in the clamping device in the spring-securing ring.

14. The electrical switching apparatus as claimed in claim 6, wherein a) a second side of the insulating nozzle is connected to one moveable component part by a second holding device, and b) the second holding device produces an interlocking and force-fitting connection between the second side of the insulating nozzle and the one moveable component part by virtue of a clamping hold and without a screw connection.

15. The electrical switching apparatus as claimed in claim 6, the electrical switching apparatus being a high-voltage switch, high-current switch or circuit breaker.

16. An interrupter unit for an electrical switching apparatus for power supply systems, the switching apparatus comprising a central axis and at least one first contact part with an insulating nozzle for blowing an arc and a second contact part and at least one of the contact parts being moveable by a switch drive, a holding device for connecting the insulating nozzle to a component part, which can move by the switch drive, of the interrupter unit being provided, wherein, the holding device produces a mechanical connection between the insulating nozzle and the component part by a clamping hold, the holding device comprises a holding ring, which is supported on the component part and which fixes the insulating nozzle with an alignment coaxially with respect to the central axis, and the holding ring fixes the insulating nozzle in the axial direction by clamping and has a restraining face for securing the insulating nozzle against sliding out in a first axial direction, wherein a) the holding ring has a second restraining face for securing the insulating nozzle against sliding out in a second axial direction, which is opposite to the first axial direction, b) the holding ring has a clamping face for being supported on the component part in the first axial direction and c) the holding ring has a second clamping face for supporting the holding device on the component part in the opposite second axial direction.

17. An electrical switching apparatus for a power supply system, characterized by an interrupter unit as claimed in claim 16.

18. The interrupter unit as claimed in claim 16 wherein the mechanical connection between the insulating nozzle and the component is without a screw connection.

19. An interrupter unit for an electrical switching apparatus for power supply systems, the switching apparatus comprising a central axis and at least one first contact part with an insulating nozzle for blowing an arc and a second contact part and at least one of the contact parts being moveable by a switch drive, a holding device for connecting the insulating nozzle to a component part, which can move by the switch drive, of the interrupter unit being provided, wherein, the holding device produces a mechanical connection between the insulating nozzle and the component part by a clamping hold, the holding device comprises a holding ring, which is supported on the component part and which fixes the insulating nozzle with an alignment coaxially with respect to the central axis, and the holding ring fixes the insulating nozzle in the axial direction by clamping and has a restraining face for securing the insulating nozzle against sliding out in a first axial direction, wherein a) the component part is a coupling element for a moveable part to be driven via the nozzle, b) the coupling element has an internal groove, and the insulating nozzle has an external groove, and c) the holding device comprises a spring-securing ring, which at the same time engages in the internal groove and the external groove in the manner of a snap-action closure.

20. The interrupter unit as claimed in claim 19, wherein a) the spring-securing ring is a ring segment having an arc length in the range of from 180° to 280° C., preferably from 200° to 250°, and/or b) the spring-securing ring is suitable for being bent up and inserted into the external groove radially from the outside, and/or c) the spring-securing ring is suitable for being pressed completely into the external groove when the component part is pushed on, and, in the pushed-on state of the component part, is latched into the internal groove by means of an elastic resetting force.

21. The interrupter unit as claimed in claim 19, wherein the moveable part to be driven via the nozzle is a moveable shielding electrode or an auxiliary gear mechanism of the switch drive.

22. The electrical switching apparatus as claimed in claim 19, wherein the component parts are a moveable buffer cylinder and a coupling element for a shielding electrode or an auxiliary gear mechanism of the interrupter unit that are to be driven via the nozzle.

23. The interrupter unit as claimed in claim 19 wherein the mechanical connection between the insulating nozzle and the component is without a screw connection.

24. The interrupter unit as claimed in claim 20, the spring-securing ring segment having an arc length in the range of from 200° to 230 °.

* * * * *